US006354272B1

(12) United States Patent
Cristiani et al.

(10) Patent No.: US 6,354,272 B1
(45) Date of Patent: Mar. 12, 2002

(54) HIGH PRESSURE PUMPING DEVICE

(75) Inventors: Marcello Cristiani, Imola; Massimo Lolli, Bologna, both of (IT)

(73) Assignee: Magneti Marelli S.p.A. (IT)

( * ) Notice: Subject to any disclaimer, the term of this patent is extended or adjusted under 35 U.S.C. 154(b) by 0 days.

(21) Appl. No.: 09/354,439

(22) Filed: Jul. 16, 1999

(30) Foreign Application Priority Data

Jul. 16, 1998 (IT) ..... B098A0436

(51) Int. Cl.[7] ..... F02M 41/00
(52) U.S. Cl. ..... 123/458; 123/495
(58) Field of Search ..... 123/514, 458, 123/495, 467, 506, 500, 501, 508, 509; 251/129.21, 129.15

(56) References Cited

U.S. PATENT DOCUMENTS

| | | | | | |
|---|---|---|---|---|---|
| 4,211,202 | A | * | 7/1980 | Hafner | 123/495 |
| 4,794,888 | A | | 1/1989 | Lang | |
| 4,829,967 | A | * | 5/1989 | Nuti | 123/458 |
| 5,476,079 | A | * | 12/1995 | Kanamori | 123/458 |
| 5,567,134 | A | | 10/1996 | Inoue | |
| 5,709,195 | A | * | 1/1998 | Drummer | 123/495 |
| 5,794,860 | A | * | 8/1998 | Neumann | 239/585.3 |
| 5,845,621 | A | * | 12/1998 | Robinson | 123/467 |
| 5,957,674 | A | * | 9/1999 | Zenmei | 123/495 |
| 5,983,869 | A | * | 11/1999 | Cooke | 123/514 |
| 6,024,064 | A | * | 2/2000 | Kato et al. | 123/179.17 |

FOREIGN PATENT DOCUMENTS

| | | |
|---|---|---|
| DE | 197 20 731 | 11/1997 |
| DE | 196 44 915 | 4/1998 |

* cited by examiner

*Primary Examiner*—Carl S. Miller
(74) *Attorney, Agent, or Firm*—Venable; George H. Spencer; Robert Kinberg

(57) ABSTRACT

A high pressure pumping device having a body provided with a cylindrical seat and a piston mounted in an axially sliding manner in the seat in order to form a variable volume pumping chamber; the chamber being in communication with an intake duct, via which it is supplied with a fluid, and with a delivery duct along which there is disposed a one-way non-return valve in order to allow the fluid to flow from the pumping chamber along this delivery duct; the pumping device further comprising an electrovalve whose opening and closing is controlled, disposed along the intake duct in order to enable the fluid to flow from and to the pumping chamber, and a control unit adapted to control the opening of the electrovalve in order to cause a controlled quantity of fluid to flow back from the chamber to the intake duct, enabling the regulation of the quantity of fluid pumped, at high pressure, along the delivery duct.

12 Claims, 4 Drawing Sheets

Top dead centre
Piston stroke
Bottom dead centre
C
t

Open
Electrovalve position
Closed
t

Q
Pump flow
t

Open
Electrovalve position
Closed
T
t

Q
Pump flow
t

HIGH PRESSURE PUMPING DEVICE

The present invention relates to a high pressure pumping device.

The field of application of the present invention is advantageously that of units for supplying fuel to the combustion chambers of an endothermal engine, to which application the following description will refer without entering into general details.

BACKGROUND OF THE INVENTION

As is known, units for supplying fuel to the combustion chambers of an endothermal engine comprise a fuel manifold within which the fuel to be supplied to the combustion chambers is stored, one or more injectors connected to the fuel manifold and adapted, on command, to supply a predetermined quantity of fuel to each combustion chamber, a fuel storage tank and a high pressure pumping device adapted to take the fuel from the storage tank in order to supply it at high pressure to the fuel manifold.

At present, the high pressure pumping device is formed by a volumetric pump provided with at least one cylinder and with a respective piston mounted in an axially sliding manner in the cylinder in order to define a variable volume pumping chamber and moving under the action of the engine camshaft. The intake of the volumetric pump is connected to the storage tank so that fuel can be suctioned into this pumping chamber, while the pump outlet is connected to the fuel manifold so that fuel can be supplied at high pressure to this manifold.

At its intake and outlet, the pump has respective one-way non-return valves, of which the valve associated with the intake enables fuel to be taken into the pumping chamber and is adapted to remain in the closed position when fuel is supplied from this chamber to the fuel manifold.

In this way, the flow from the volumetric pump is solely a function of the speed of rotation of the camshaft (i.e. the number of revolutions per minute of the engine crankshaft), and, in operation, a quantity of fuel that is greater than the quantity to be supplied to the injectors is supplied to the manifold in a cyclic manner.

Consequently, the above-mentioned supply units make it necessary to use a recycling duct connecting the fuel manifold to the tank so that the surplus quantity of fuel can be returned to the tank or, in any case, upstream of the intake of the volumetric pump. This recycling duct is in particular connected to the fuel manifold by means of a pressure regulator of proportional type which is adapted to prevent the pressure of the fuel in the manifold from exceeding a predetermined threshold value and is adapted to introduce the surplus fuel into the recycling duct.

These known supply units have certain drawbacks connected in particular with the above-described volumetric pumps.

In the first place, given that the manifold is located at a substantial distance from both the tank and the volumetric pump, the recycling duct is very long and is therefore difficult to locate within the engine space. As highly inflammable fuel passes through it, the recycling duct must be disposed in a protected position remote from sources of heat or from cutting components that could compromise its structural integrity.

Secondly, the pumping device must supply at its outlet a pressure such as to ensure both that fuel flows into the manifold and that surplus fuel is returned via the recycling duct, with a substantial waste of energy.

A solution that partially resolves the above-mentioned problems is disclosed in German Patent Application DE 196 44 915.

According to this solution, the valve disposed at the intake of the volumetric pump is formed by an electrovalve whose opening and closing is controlled on the basis of the position of the camshaft. In particular, during an initial phase of delivery, the electrovalve is caused to open for a predetermined period of time, so as to allow a quantity of fuel to flow back through the intake duct and therefore to regulate the flow and pressure of the fuel supplied to the manifold.

This latter solution also has certain drawbacks, however, due chiefly to the fact that the electrovalve must be appropriately designed and produced in order to be applied to the volumetric pump. This is disadvantageous in particular from the economic point of view and may also entail problems of bulk.

SUMMARY OF THE INVENTION

The object of the present invention is to provide a high pressure pumping device which resolves the above-described drawbacks and which is, in particular, simple and economic to produce.

The present invention therefore relates to a high pressure pumping device of the type described in claim 1.

The present invention also relates to a unit for supplying fuel to an endothermal engine provided with a high pressure pumping device.

The present invention further relates to a unit for supplying fuel to at least one combustion chamber of an endothermal engine of the type described in claim 9.

BRIEF DESCRIPTION OF THE DRAWINGS

The present invention is described below with reference to the accompanying drawings, which show a non-limiting embodiment thereof, in which.

DETAILED DESCRIPTION OF THE INVENTION

Figure 1:
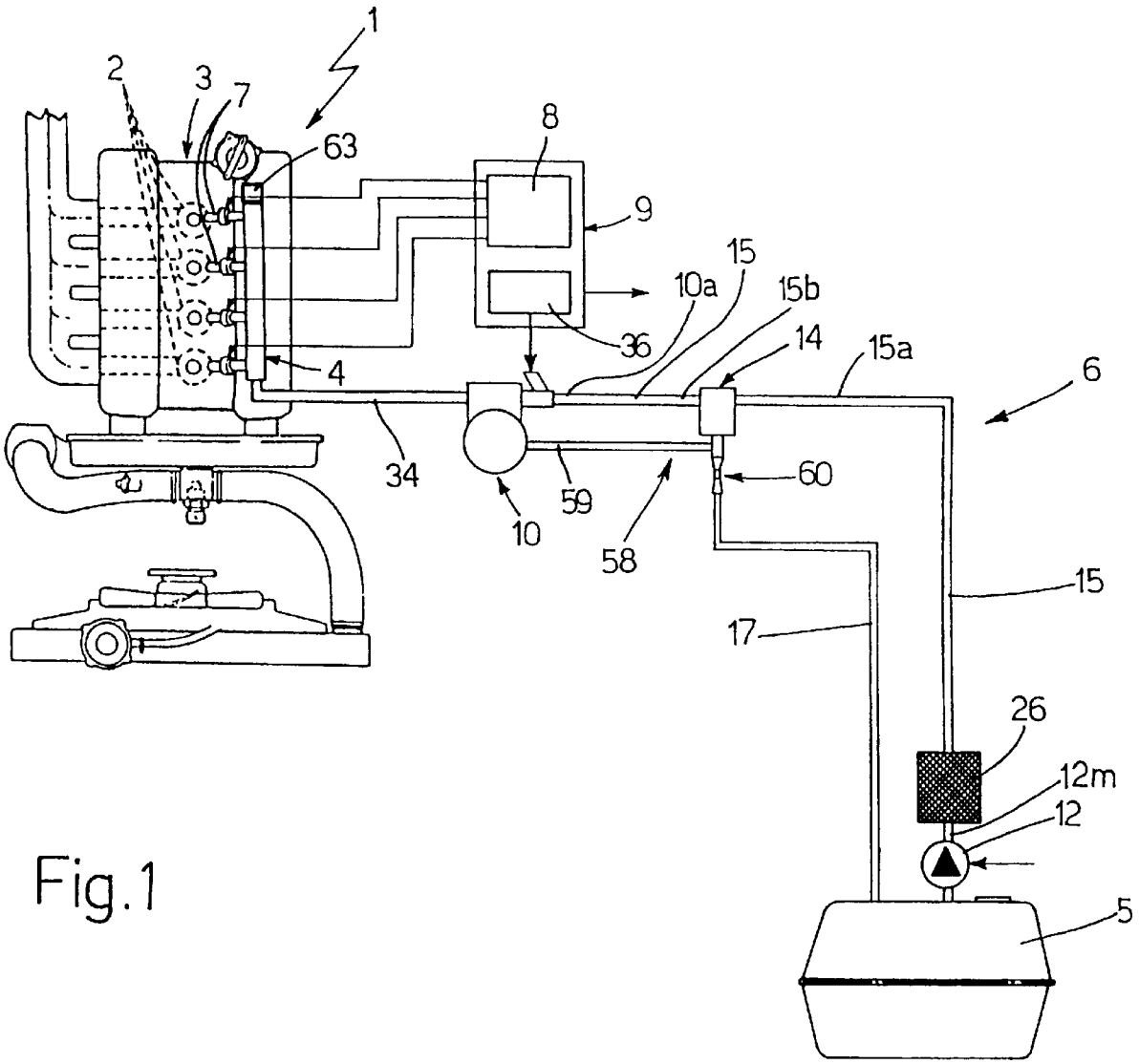
FIG. 1 is a diagram of a unit for supplying fuel to an endothermal engine provided with a high pressure pumping device in accordance with the present invention.

In FIG. 1, a unit for supplying fuel to the combustion chambers 2 of an endothermal engine 3 of known type is shown overall by 1.

The supply unit 1 is of the "direct injection" type, i.e. is adapted to supply, on command, a predetermined quantity of fuel to each combustion chamber 2 by atomising the fuel directly within this chamber 2.

The supply unit 1 comprises a fuel manifold 4 adapted to receive and store the fuel before it is supplied to the combustion chambers 2, a fuel storage tank 5 in which the fuel needed for the operation of the engine 3 is stored and a supply circuit 6 (described in detail below) which connects the tank 5 to the manifold 4 so that fuel can be taken from the tank 5 and supplied to this manifold 4.

The supply unit 1 further comprises a predetermined number of injectors 7 (of known type) interposed between the manifold 4 and the engine 3 in order to supply, on command, a predetermined quantity of fuel contained in the manifold 4 to the combustion chambers 2 and a drive unit 8 for the injectors 7 adapted to control the opening and closing of these injectors 7 as a function of the operating conditions of the engine 3. In the embodiment shown, the number of injectors 7 is in particular equal to the number of combustion chambers 2 contained in the engine 3 and the drive unit 8 is integrated into the engine control unit 9 which is responsible for overall management of the engine 3.

The supply circuit 6 comprises a high pressure pumping device 10 interposed between the tank 5 and the manifold 4 so that fuel can be suctioned and supplied at high pressure to the manifold 4. According to the present invention, the pumping device 10 is in particular adapted to regulate the pressure and flow of the fuel introduced into the manifold 4 as a function of the quantity of fuel that needs to be supplied to the combustion chambers 2 so as to prevent a quantity of fuel greater than that which needs to be supplied to the chambers 2 from being introduced into the manifold 4.

The supply circuit 6 further comprises a low pressure extraction pump 12 interposed between the tank 5 and the pumping device 10 in order to suction the fuel from the tank 5 and supply it at low pressure to the pumping device 10.

The supply circuit 6 lastly comprises a pressure regulator 14 of known type which is disposed along a duct 15 connecting the outlet 12*m* of the pump 12 to the intake 10*a* of the pumping device 10. The regulator 14 defines, on this duct 15, two portions 15*a* and 15*b*, the portion 15*a* of which is defined between the regulator 14 and the pump 12, while the portion 15*b* is defined between the regulator 14 and the intake 10*a*. The regulator 14 is adapted to prevent the pressure of the fuel supplied to the intake 10*a* from exceeding a predetermined threshold value (for instance 4 bar). In order to carry out regulation of the pressure, the regulator 14 is connected to the tank 5 by means of a bleed duct 17 along which the surplus fuel from the extraction pump 12 is conveyed.

Figure 3:
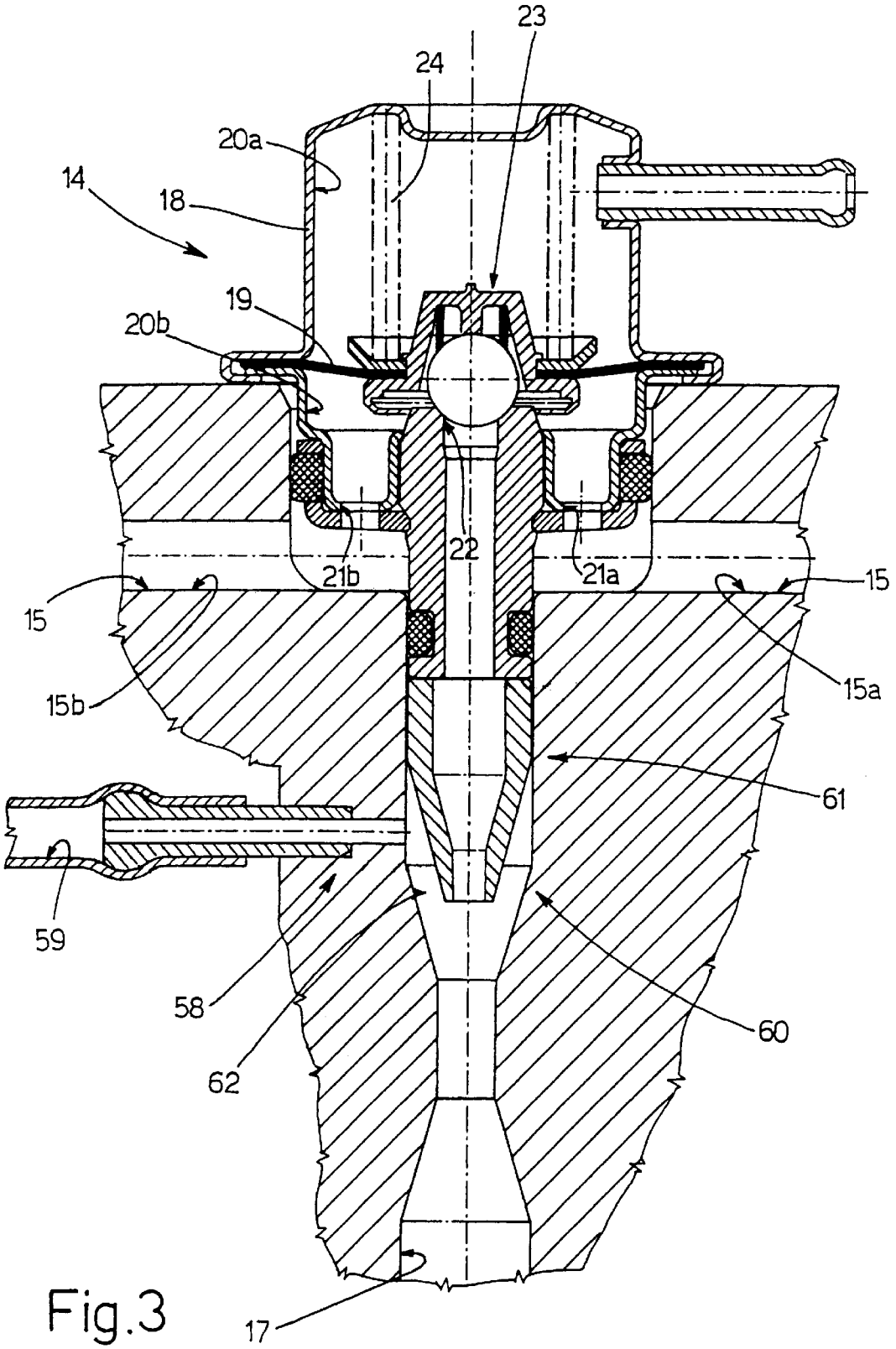
FIG. 3 shows a pressure regulation device forming part of the supply unit of FIG. 1.

The pressure regulator 14 (see FIG. 3) is formed by a housing 18 provided internally with an elastic membrane 19 which divides the housing 18 into two chambers 20*a* and 20*b*, the chamber 20*b* of which has a hole 21*a* communicating with the portion 15*a* of the duct 15, a hole 21*b* communicating with the portion 15*b* and an opening 22 communicating with the bleed duct 17.

The membrane 19 bears a closure device 23 disposed at the location of the opening 22 in order to enable the excess fuel to pass from the chamber 20*b* to the bleed duct 17 when the pressure within the chamber 20*b* exceeds the predetermined threshold value (4 bar). This closure device 23 is kept in the position closing the opening 22 under the action of a calibrated spring 24 so as to close off the duct 17 if the pressure within the chamber 20*b* is lower than the threshold value.

As shown in FIG. 1, the supply circuit 6 may also be provided with a fuel filter 26 disposed along the duct 15 downstream of the pump 12 in order to eliminate any impurities from the fuel before it is supplied to the manifold 4 by the pumping device 10.

Figure 2:
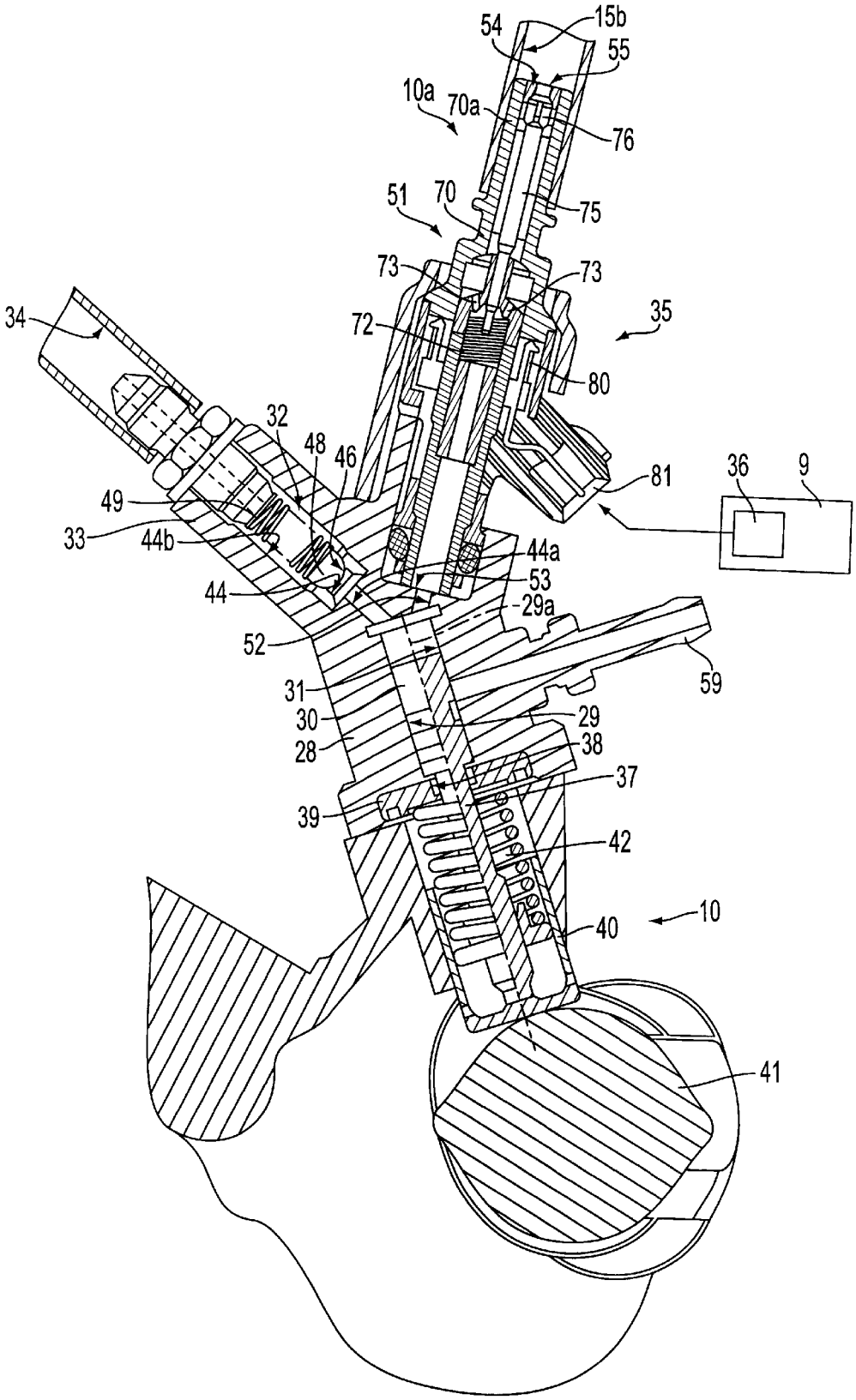
FIG. 2 shows the pumping device of FIG. 1, with some parts in cross-section and others removed for clarity.

In FIG. 2, the high pressure pumping device 10 comprises a main body 28 provided with a cylindrical seat 29 extending along an axis 29*a*, and a piston 30 mounted in an axially sliding manner within the seat 29 in order to define a variable volume pumping chamber 31. The pumping device 10 further comprises a valve device 32 borne by an end portion 33 of the body 28 and adapted to bring the pumping chamber 31 into communication with a duct 34 connecting the pumping device 10 to the manifold 4 so that fuel can be supplied to this manifold 4. The pumping device 10 lastly comprises a regulation valve device 35, which is borne by the main body 28 and is adapted to bring the pumping chamber 31 into communication with the portion 15*b* of the duct 15 under the control action of a control unit 36 which is also integrated into the control unit 9 of the engine 3. The valve device 35 is adapted to enable fuel to be supplied to the pumping chamber 31 and part of the fuel supplied to this chamber 31 to be discharged along the duct 15 towards the bleed duct 17 when, in operation, the piston 30 reduces the volume of the pumping chamber 31; in other words, the valve device 35 is adapted to enable regulation of the pressure and flow of fuel pumped to the manifold 4 by regulating the discharge of fuel from the pumping chamber 31 to the bleed duct 17.

The piston 30 comprises a rod 37 which is mounted in a through manner within a hole 38 provided in an end flange 39 of the body 28, extends along the axis 29*a* externally to this body 28 and is connected to a sliding pan 40 of known type disposed on the camshaft 41 of the engine 3. In this way, the piston 30 can move axially under the action of the camshaft 41 between a forward position (known as the top dead centre), at the location of which the volume of the pumping chamber 31 is minimised, and a retracted position (known as the bottom dead centre), in which the volume of this chamber 31 is maximised.

A recall spring 42 is provided between the flange 39 and the pan 40; this spring 42 is wound about the rod 37 and is adapted, in a known manner, to ensure continuous contact between this pan 40 and the camshaft 41. In particular, this spring 42 is adapted to exert an axial recall force on the rod 37 adapted to lock the pan on the camshaft 41 during the stroke of the piston 30 from the forward position (top dead centre) to the retracted position (bottom dead centre), i.e. during the suction of the fuel into the pumping chamber 31.

The end portion 33 of the body 28 is provided internally with a duct 44 which defines the delivery duct of the pumping device 10 and connects the pumping chamber 31 with the duct 34 communicating with the manifold 4. In the embodiment shown in FIG. 2, the end portion 33 is connected to the duct 34 by means of a sleeve 45.

The delivery duct 44 has two cylindrical sections 44*a* and 44*b*, of which the section 44*a* connects the chamber 31 to the section 44*b*, has a cross-section of smaller dimension than the cross-section of the section 44*b* and is connected to this section 44*b* in order to form a shoulder 46.

The valve device 35 is formed by a one-way non-return valve which, in the embodiment shown, has a sphere 48 housed in the section 44*b* of the duct 44 and a spring 49 interposed between the sleeve 45 and the sphere 48 in order to urge the sphere 48 into contact with the shoulder 46 and to close off the section 44*a*. In particular, the spring 49 is calibrated such that it enables the sphere 48 to close off the section 44*a* as rapidly as possible after the pumping stroke of the piston 30, i.e. after the forward position (top dead centre) has been reached. During pumping of the fuel, when the piston 30 is displaced from the retracted bottom dead centre position, the pressure of the fuel within the section 44*a* overcomes the action of the spring 49 and displaces the sphere 48 from the shoulder 46 making it possible for fuel to flow from the pumping chamber 31 to the duct 34.

The regulation valve device 35 comprises an electrovalve 51 with controlled opening and closing of known type, which is keyed on the main body 28 and is adapted to be controlled by the control unit 36 in order to bring the duct 15 into communication with a duct 52 provided in the body 28 and communicating with the pumping chamber 31. In particular, as shown in FIG. 2, the duct 52 defines the intake duct of the pumping device 10.

The electrovalve 51 is adapted to be brought into the open position both during the suction of the fuel from the duct 16 to the chamber 31 and during the supply of the fuel from the chamber 31 to the manifold 4 so as to enable, as a result of the discharge of fuel to the duct 15, the regulation of the flow and therefore the pressure of the fluid supplied to the manifold 4.

The electrovalve 51 is formed by a standard known injector 51 of the same type as the injectors 7 used to supply, on command, a predetermined quantity of fuel to the combustion chambers 2. The injector 51 in particular comprises a housing 70 comprising, at its respective ends, a first aperture 53 and a second aperture 54 defining a nozzle 55. The injector 51 is, moreover, keyed on the main body 28 and is disposed such that the first aperture 53 is disposed at the mouth of the duct 52, while an end portion 70*a* of the housing 70 is threaded into an end section of the portion 15*b* of the duct 15.

The housing 70 is provided internally with a longitudinal through cavity 71 of substantially cylindrical shape, disposed coaxially with the intake duct 52 and with the end section of the portion 15*b* of the duct 15, in order to form therebetween a substantially rectilinear passage for the fuel. A moving ferromagnetic member 72, provided with holes 73 for the passage of fuel and a rod 75, sliding axially and rigid with one another, are also housed in the longitudinal through cavity 71. The rod 75 bears, at one end and at the location of the nozzle 55, a shutter 76 adapted to prevent fuel from passing through the nozzle 55 when kept in a closed position.

An opposing spring 77, disposed between the moving ferromagnetic member 72 and an abutment member 78, urges the moving ferromagnetic member 72 back in order to keep the shutter 76 in the closed position.

The injector 51 further comprises an electromagnet 80 connected to the control unit 36 via a connector 81 and adapted, when traversed by current, to move the moving ferromagnetic member 72 and the rod 75 along the longitudinal through cavity 71 in order to dispose the shutter 76 in an open position and allow fuel to pass through the nozzle 55.

According to the present invention, the supply unit 1 (FIG. 1) is provided with a fuel recovery system 58 adapted to recover the fuel which, during the operation of the pumping device 10, may escape from the pumping chamber 31 towards the flange 39 because of possible play resulting from the imperfect coupling of the piston 30 with the cylindrical seat 29. This system 58 is adapted to prevent the fuel leaking from the pumping chamber 31 from possibly emerging from the hole 38 and coming into dangerous contact with the engine components in the vicinity of the body 28.

In the embodiment shown and with reference to FIGS. 1 and 2, the recovery system 58 has a leakage duct 59 connecting the cylindrical seat 29 to the bleed duct 17 and an ejector 60 which is disposed along this duct 17 in communication with the leakage duct 59 and is adapted to enable leakages of fuel to be conveyed in the duct 59 to the storage tank 5.

The duct 59 is in particular disposed via the body 28 up to the cylindrical seat 29 and faces the piston 30 below the pumping chamber 31 such that it never directly faces this chamber 31.

In the embodiment shown (see FIG. 3), the ejector 60 is formed by a Venturi tube 61 disposed at the location of the regulator 14 with its throttle 62 communicating with the leakage duct 59. The Venturi tube 61 creates a vacuum at the location of its own throttle 62 when, in operation, the duct 17 is traversed by the fuel which is being conveyed to the storage tank 5. This vacuum recalls any fuel that may have leaked from the pumping chamber 31 towards the bleed duct 17.

The operation of the supply unit 1 will now be described taking into account solely one suction/pumping cycle of the pumping device 10, i.e. a time span C (FIG. 4) in which the piston 30 is actuated by the camshaft 41 in order to carry out a forward stroke and a return stroke from the forward top dead centre position.

When the piston 30 reaches the relative forward top dead centre position, the control unit 36 controls the opening of the electrovalve 51. During suction, i.e. during the displacement of the piston 30 from the forward top dead centre position to the retracted bottom dead centre position, the electrovalve 51 is kept open enabling fuel to be suctioned from the duct 16 to the pumping chamber 31 and ensuring, at the same time, that correct filling of the cylinder has taken place without vacuums that could lead to the formation of bubbles of evaporated fuel being created.

During the suction stage, while the piston 30 is performing its stroke towards the relative retracted bottom dead centre position, the engine control unit 9 calculates the quantity of fuel that needs to be supplied to the combustion chambers 2 of the injectors 7 and, ultimately, determines the quantity of fuel that needs to be supplied from the pumping chamber 31 to the manifold 4.

The control unit 36 (i.e. the unit 9) then determines the time interval T in which, during the subsequent pumping stage, the electrovalve 51 needs to be kept open in order to ensure that the surplus fuel present in the pumping chamber 31 is discharged into the portion 15*b* of the duct 15.

Figures 4, 5, 6, 7, 8:
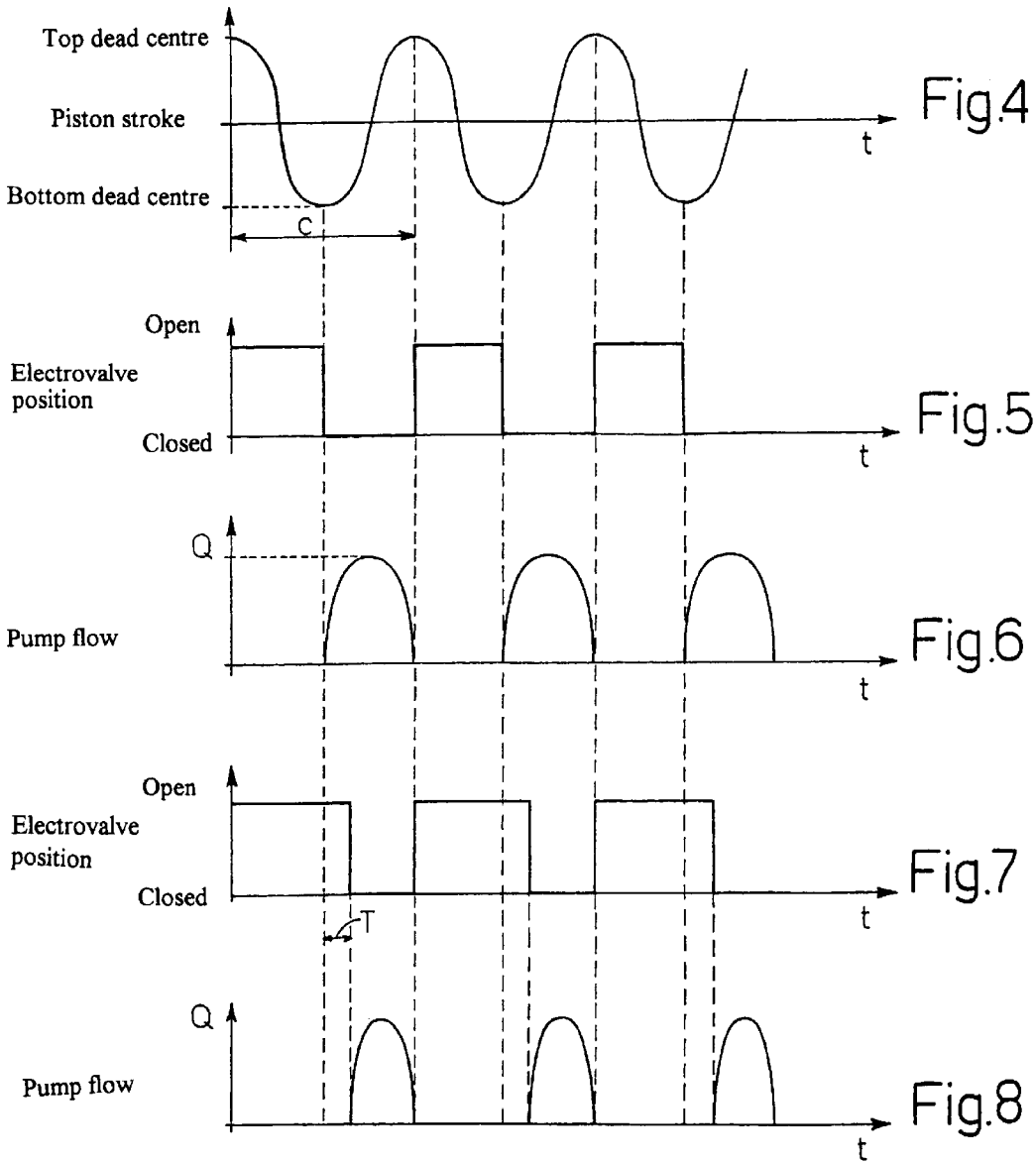
FIGS. 4 to 8 each show the time curve of a respective magnitude relating to the operation of the supply unit of FIG. 1.

If all the fuel suctioned into the chamber 31 has to be introduced at high pressure into the manifold 4, i.e. whenever the maximum flow is required, the control unit 36 controls the closure of the electrovalve 51 in phase with the positioning of the piston 30 in its relative retracted bottom dead centre position. In this case, the electrovalve 51 remains closed for the entire pumping phase and all the fuel contained in the chamber 31 is pumped into the manifold 4 through the delivery duct 44. This situation is shown in FIGS. 5 and 6, in which FIG. 5 shows the condition of the electrovalve 51 as a function of time and FIG. 6 shows the curve of the flow of fuel introduced into the manifold 4.

If, however, the quantity of fuel to be supplied to the manifold 4 is lower than that suctioned into the pumping chamber 31, the electrovalve 51 is kept open for the above-mentioned time interval T during the pumping stroke of the piston 30 and the surplus quantity of fuel is introduced into the duct 15. This surplus fuel is supplied to the chamber 20*b* of the regulator 14 where, overcoming the action of the spring 24 (FIG. 3), it causes the closure device 23 to be displaced and is introduced into the bleed duct 17. After the time interval T, the control unit 36 controls the closure of the electrovalve 51 such that the desired quantity of fuel can be pumped into the manifold 4 via the delivery duct 44. This situation is illustrated in FIGS. 7 and 8 which show, as a function of time, the position of the electrovalve 51 and, respectively, the flow of fuel entering the manifold 4.

When no fuel needs to be supplied to the manifold 4 (for instance when the engine is in the "cut-off" operating condition), the electrovalve 51 remains open throughout the pumping stroke of the piston 30 and all the fuel flows back to the tank 5.

As a result of the regulation of the opening time of the electrovalve 51 during the pumping stroke of the piston 30, it is thus possible to modulate the flow of fuel which is supplied to the manifold 4 and, at the same time, to regulate the pressure of the fuel within this manifold 4.

It should be stressed that the supply unit 1 may be provided with a mechanical pressure damping device 63 at the location of the manifold 4 (FIG. 1) in order to damp any pressure peaks in this manifold 4 before the fuel is injected by the injectors 7 into the combustion chamber 2.

The advantages of the supply unit 1 with respect to the known devices described above are as follows.

In the first instance, the fact that the electrovalve 51 is formed by a standard injector of the same type as used to supply fuel to the combustion chambers is economically advantageous since it makes it possible to reduce the number of production stages required for the production of the pumping device.

The injector is, moreover, advantageously disposed such that the cavity 71, the intake duct 52 and the end section of the portion 15*b* of the duct 15 form a passage for the fuel which is substantially rectilinear and free from bends.

The pumping device as described is also advantageous in that the inclusion of the regulation valve device 35, and in particular the electrovalve 51, ensures the direct regulation of the flow of fuel introduced at high pressure into the manifold 4 in such a way as to obviate the need for a recycling duct connected to this manifold 4.

It is also evident that the pumping device 10 substantially reduces energy dissipation as it is no longer necessary to supply the fuel to the manifold 4 at a pressure such as to ensure that surplus fuel is returned to the tank via the recycling duct.

Lastly, the inclusion of the leakage duct 59 and the Venturi tube 61 ensures the recovery of any fuel that may have leaked because of the imperfect connection between the piston 30 and the cylindrical housing 29, ensuring the safety of the engine components in the vicinity of the pumping device 10.

What is claimed is:

1. A high pressure pumping device comprising;

a body including at least one seat and at least one piston mounted in an axially sliding manner within the seat and forming a variable volume pumping chamber;

an intake duct via which a fluid is conveyed into the variable volume pumping chamber;

an inlet duct having an end section connected to said intake duct:

a delivery duct via which the high pressure fluid output from the pumping chamber is conveyed;

a first valve means disposed along the intake duct in order to enable the fluid to flow to the pumping chamber and comprising an electrovalve whose opening and closing is controlled, and a second valve means disposed along the delivery duct which selectively enables the fluid to flow along the delivery duct wherein the electrovalve comprises an injector, keyed on the body and having a first aperture facing the intake duct, a second aperture forming a nozzle that is disposed axially opposite to the first aperture and is connected to the end section of the inlet duct, and a longitudinal through cavity, having a substantially cylindrical shape and being disposed coaxially with both the intake duct and the end section of the inlet duct, thereby forming a substantially rectilinear fuel passage therebetween.

2. A pumping device as claimed in claim 1, wherein the second valve means are one-way non-return valve means and are adapted to allow fluid to pass along the delivery duct solely from the pumping chamber to the delivery duct.

3. A pumping device as claimed in claim 1, wherein the piston has a rod extending externally to the body and connecting to a cam device which causes the piston to slide internally with respect to the seat between a forward position and a retracted position in order to vary the volume of the pumping chamber making it possible to suction fluid into this chamber and to pump fluid to the delivery and intake ducts.

4. A pumping device as claimed in claim 3, wherein the control unit keeps the first valve means in the open position during the stroke of the piston from the forward position to the retracted position during the stage of suction of the fluid from the intake duct to the pumping chamber, the control unit keeping the first valve means in the open position for a predetermined time interval (T) during the stroke of the piston from the retracted position to the forward position so as to regulate the quantity of fluid that is supplied from the pumping chamber to the delivery duct.

5. A pumping device as claimed in claim 1, furhter comprising a leakage duct disposed with one end facing the seat in an offset position with respect to the pumping chamber and an ejector connected to the leakage duct in order to supply, along this leakage duct, any fluid that may accidentally have leaked from the pumping chamber along a zone of connection of the piston to the seat.

6. A supply unit for supplying fuel to at least one combustion chamber of an endothermal engine, the supply unit comprising a fuel manifold, at least one injector unit connected to the fuel manifold in order to supply, on command, a predetermined quantity of fuel to the combustion chamber, a fuel storage tank and a high pressure pumping device according to claim 1 for supplying fuel at high pressure from the tank to the fuel manifold.

7. A supply unit as claimed in claim 6, further comprising a low pressure extraction pump for taking the fuel from the tank and supplying it to the high pressure pumping device, the supply unit further comprising a pressure regulation device interposed between the outlet of the extraction pump and the intake of the pumping device and a bleed duct, thus connecting the regulation device to the tank, the regulation device preventing the pressure of the fuel supplied from the extraction pump to the intake of the pumping device from being above a predetermined threshold value, and being adapted to supply the fuel supplied via the piston from the pumping chamber along the intake duct to the bleed duct.

8. A supply unit as claimed in claim 6, wherein the control unit of the first valve means is integrated into the control unit of the engine, and the cam device that actuates the piston is formed by part of the camshaft of the engine.

9. A supply unit as claimed in claim 7, further comprising a fuel recovery system adapted to recover any fuel that may leak from the pumping chamber towards the exterior of the body, this recovery system further including a leakage duct disposed with one end facing the seat in an offset position with respect to the pumping chamber and an ejector disposed along the bleed duct in order to transport any fuel that has leaked from the pumping chamber along the leakage duct and then along the bleed duct.

10. A supply unit as claimed in claim 9, wherein the ejector is formed by comprises a Venturi tube and the leakage duct has a further end at the location of the throttle of the Venturi tube.

11. A supply unit as claimed in claim 7, further comprising a fuel filter disposed downstream of the outlet of the extraction pump in order to eliminate any impurities from the fuel suctioned from the tank.

12. A supply unit as claimed in claim 6, further comprising a pressure damping device disposed at the location of the fuel manifold in order to damp any pressure peaks within this manifold before the fuel is injected from the injector unit into the combustion chamber of the engine.

* * * * *